US008344256B2

(12) United States Patent
Ancilotto

(10) Patent No.: US 8,344,256 B2
(45) Date of Patent: Jan. 1, 2013

(54) MODULAR POLYMERIC INSULATOR FOR INSTALLATION ALONG AN OVERHEAD POWER DISTRIBUTION NETWORK

(75) Inventor: Rodnei Ancilotto, São Paulo (BR)

(73) Assignee: Prysmian Energia Cabos E Sistemas Do Brasil S.A., Sorocaba, SP (BR)

( * ) Notice: Subject to any disclaimer, the term of this patent is extended or adjusted under 35 U.S.C. 154(b) by 982 days.

(21) Appl. No.: 11/629,165

(22) PCT Filed: Jun. 9, 2005

(86) PCT No.: PCT/BR2005/000104

§ 371 (c)(1),
(2), (4) Date: Dec. 28, 2007

(87) PCT Pub. No.: WO2005/122187

PCT Pub. Date: Dec. 22, 2005

(65) Prior Publication Data

US 2011/0147049 A1 Jun. 23, 2011

(30) Foreign Application Priority Data

Jun. 11, 2004 (BR) ..... 0401954

(51) Int. Cl.
*H01B 17/00* (2006.01)
*H01B 17/06* (2006.01)

(52) U.S. Cl. ..... 174/174; 174/158 R

(58) Field of Classification Search ..... 174/174
See application file for complete search history.

(56) References Cited

U.S. PATENT DOCUMENTS

| | | | | | |
|---|---|---|---|---|---|
| 269,933 | A | * | 1/1883 | Higgs et al. | 174/169 |
| 289,449 | A | * | 12/1883 | Rousseau | 174/174 |
| 600,607 | A | * | 3/1898 | Benedict | 174/163 R |
| 701,246 | A | * | 5/1902 | Baily | 174/163 R |
| 701,847 | A | * | 6/1902 | Converse | 174/195 |
| 701,848 | A | * | 6/1902 | Converse | 174/195 |
| 735,212 | A | * | 8/1903 | Converse | 174/195 |
| 960,827 | A | * | 6/1910 | Conway et al. | 174/163 R |
| 1,328,687 | A | * | 1/1920 | Plimpton | 248/226.12 |
| 1,435,225 | A | | 11/1922 | Gilchrest | |

(Continued)

FOREIGN PATENT DOCUMENTS

BR PI 0103075-2 7/2001

(Continued)

OTHER PUBLICATIONS

Supplementary European Patent Search Report for EP 05 75 0858, dated Jul. 30, 2008.

*Primary Examiner* — Timothy Thompson
*Assistant Examiner* — Nathan Milakovich
(74) *Attorney, Agent, or Firm* — Finnegan, Henderson, Farabow, Garrett & Dunner, L.L.P.

(57) ABSTRACT

A modular polymeric insulator for overhead power distribution networks. The insulator includes a first insulating module adjacent to a supporting element; at least one further insulating module superimposed to the first insulating module and a non-metallic pin extending through the first insulating module and the at least one further insulating module. The modular polymeric insulator has a similar performance to a "Post type" insulator with the advantage of being resistant to impact and much lighter than a "Post type" insulator.

20 Claims, 1 Drawing Sheet

U.S. PATENT DOCUMENTS

| | | | | | |
|---|---|---|---|---|---|
| 1,446,135 | A | | 2/1923 | Steinberger | |
| 1,694,415 | A | * | 12/1928 | Gordon | 174/174 |
| 2,914,602 | A | * | 11/1959 | Cougnard | 174/140 R |
| 3,739,075 | A | * | 6/1973 | Jean et al. | 174/40 R |
| 4,010,316 | A | * | 3/1977 | Jolly et al. | 174/140 R |
| 4,940,857 | A | * | 7/1990 | Giroux | 174/174 |
| 4,965,407 | A | * | 10/1990 | Hamm | 174/31 R |
| 5,413,443 | A | * | 5/1995 | Aghamehdi | 411/383 |
| 5,877,453 | A | * | 3/1999 | Hill | 174/179 |
| 5,942,731 | A | * | 8/1999 | Rogerson | 174/163 R |
| 5,945,636 | A | * | 8/1999 | Sakich et al. | 174/174 |
| 5,949,028 | A | * | 9/1999 | Verfurth et al. | 174/158 R |
| 5,981,878 | A | * | 11/1999 | Zhao et al. | 174/158 R |
| 5,981,879 | A | * | 11/1999 | Blanding | 174/168 |
| 6,150,613 | A | * | 11/2000 | Bergstrom | 174/152 R |
| 6,316,724 | B1 | * | 11/2001 | Blanding | 174/40 R |
| 6,485,598 | B2 | * | 11/2002 | Brocard et al. | 156/245 |
| 6,906,155 | B1 | * | 6/2005 | Minami et al. | 526/160 |
| 7,199,202 | B2 | * | 4/2007 | Minami et al. | 526/351 |
| 2003/0088000 | A1 | * | 5/2003 | Kimura et al. | 524/115 |

FOREIGN PATENT DOCUMENTS

| | | |
|---|---|---|
| BR | PI 0001482-6 | 9/2001 |

* cited by examiner

MODULAR POLYMERIC INSULATOR FOR INSTALLATION ALONG AN OVERHEAD POWER DISTRIBUTION NETWORK

CROSS REFERENCE TO RELATED APPLICATION

This application is a national phase application based on PCT/BR2005/000104, filed Jun. 9, 2005, and claims the priority of Brazilian application no. PI0401954-7, filed Jun. 11, 2004, the content of both of which is incorporated herein by reference.

The present invention refers to a modular polymeric insulator which is suitable for being installed along overhead primary power distribution networks (typically from 3.8 kV to 34.5 kV).

Generally, the modular polymeric insulator of the present invention is suitable for being installed on the cross arms of a pole or directly on the pole, for example in accordance with NBR 5433 and NBR 5434 Standards.

STATE OF THE ART

Conventional overhead primary power networks typically comprise one or more conductors which are secured to a supporting element (e.g. a pole) by means of an insulator which is generally made of porcelain, glass or a polymeric material.

In the most common practice, preferably the insulators are the so-called "pin type" insulators.

In the present description, by "Pin type" insulator it is meant an insulator which comprises one or more insulator bodies stacked together, usually provided with sheds on the outer surface to improve electrical performance. This kind of insulator is fastened to a supporting element (e.g. a pole cross arm) through a "long" metallic pin screwed into the insulator body or bodies. The word "long" means here a pin that extends nearly for the whole length of the insulator bodies stack.

The above cited metallic pins of the "Pin type" insulators provide the latter with high mechanical resistance for withstanding, the weight of the cable, the tensile force and the action of the wind occurring on the power line or the insulators.

Therefore, the pins of the "Pin type" insulators are also subjected to flexural and shearing stresses which occur on the insulators, for instance, when the power line is subjected to a direction change. According to the standards for designing and building overhead networks, the side portion of the insulators are required to support the conductors during said changes of direction. Generally, in such circumstances, in order to increase the flexural resistance of the insulators, two sets of cross arms, pins and insulators are provided to divide mechanical stresses.

Furthermore, tensile stresses as well as compression stresses can originate along the axis of the pin, especially in correspondence of the thread portion of the pin which is provided for fastening the insulating module(s) to the pin.

Moreover, the use of metallic pins has the following drawbacks:

a) concentration of the electric field at the upper part of the insulator, particularly at the region between the conductor and the pin (equipotential surfaces);

b) occurrence of ionization at the lower part of the insulator threading which causes the formation of radio interference;

c) formation of leakage currents;

d) breakage during transport, installation or acts of vandalism, due to the fragility to impact of porcelain or glass;

e) corrosion of the metallic pin in aggressive environments;

f) high maintenance costs due to the above mentioned problems.

In order to solve some of said problems, insulators provided with non-metallic pins have been provided.

For instance, document BR PI 0001482-6 A describes an insulator comprising a ceramic or polymeric body and a pin made of a plastic material.

Moreover, document BR PI 0103075-2—in the name of the same Applicant—discloses a non-metallic pin which is used as an interface between a "pin type" insulator and a metallic pin for fastening an insulator to a supporting element. According to said document the non-metallic pin is provided with a protective covering which confers to the non-metallic pin tracking and erosion resistance.

In alternative to "pin type" insulators, the so-called "post type" insulators are also used.

In the present description, by "Post type" insulator it is meant an insulator which comprises one or more insulator bodies stacked together, usually provided with sheds on the outer surface to improve electrical performance. This kind of insulator is fastened to a support (e.g. a pole cross arm) by means of a relatively short bolt or pin, whose length does not extend beyond the basis of the insulator body. (the lower body in case of a stack). Therefore, the total insulator size is longer, which improves the electrical performance of the "Post-type" insulator with respect to a "Pin-type" insulator. Such type of insulator is known also as "Pillar type".

Generally, the "Post-type" insulators are more expensive and heavy and still fragile to impact than the "Pin type" insulators.

SUMMARY OF THE INVENTION

The Applicant has perceived the need to provide the insulators with increased mechanical resistance and dielectric strength in order to avoid, or at least to reduce, the drawbacks mentioned above.

The Applicant has found that such a result can be obtained by providing the insulator with at least two insulating modules which are joined together by means of a non-metallic pin which is received in a bore provided inside said insulating modules.

In details, the modular polymeric insulator of the present invention comprises: a first insulating module, at least one further insulating module superimposed to said first insulating module and a non-metallic pin which extends through said first insulating module and said at least one further insulating module.

The first insulating module is the one—among the plurality of insulating modules which usually form the insulator—which is adjacent to the supporting element of the modular polymeric insulator and is arranged to ensure the fastening with said supporting element.

The first insulating module and the at least one further insulating module are provided with a bore for receiving the non-metallic pin.

The first insulating module is provided with a recess for receiving a fastening means which is suitable for fastening the modular polymeric insulator to a supporting device, e.g. a pole. Preferably, said fastening means is a metallic pin or a bolt which is generally used in the so-called "Post type" insulators.

The insulating modules are manufactured of the same polymeric material and the non-metallic pin is completely encased by the insulating modules so that no tracking or weathering resistance have to be specifically conferred to the non-metallic pin.

The distinct parts of the modular polymeric insulator (i.e. the insulating modules and the non-metallic pin) are manufactured separately. This is particularly advantageous since the formation of elements of great volume can be avoided and the manufacturing process is remarkably facilitated, thus resulting in reduced final costs and improved reliability.

DESCRIPTION OF THE DRAWINGS

The description, provided hereinbelow, relates to the accompanying drawings provided solely by way of explanation and not intended to be limiting in any way, wherein.

DESCRIPTION OF THE INVENTION

Figure 1:
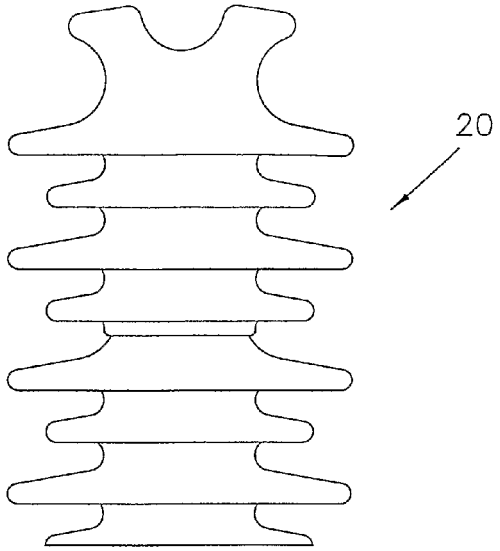
FIG. 1 is a side view of a modular polymeric insulator of the present invention.
Figure 2:
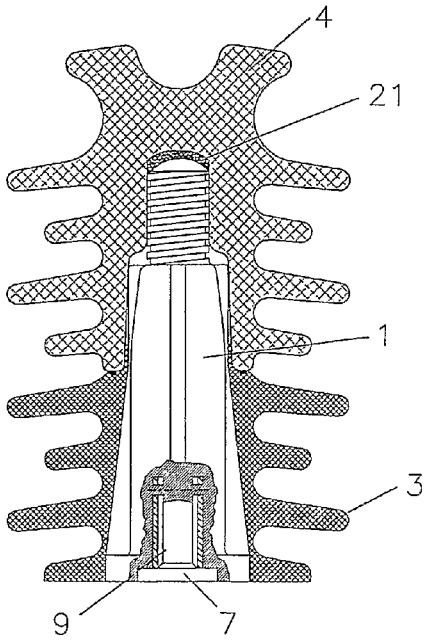
FIG. 2 is a partially sectioned side view of a modular polymeric insulator of the present invention.

FIG. 1 is a side view of a modular polymeric insulator 20 according to the present invention, said insulator being provided with two insulating modules superimposing each other.

Figure 3:
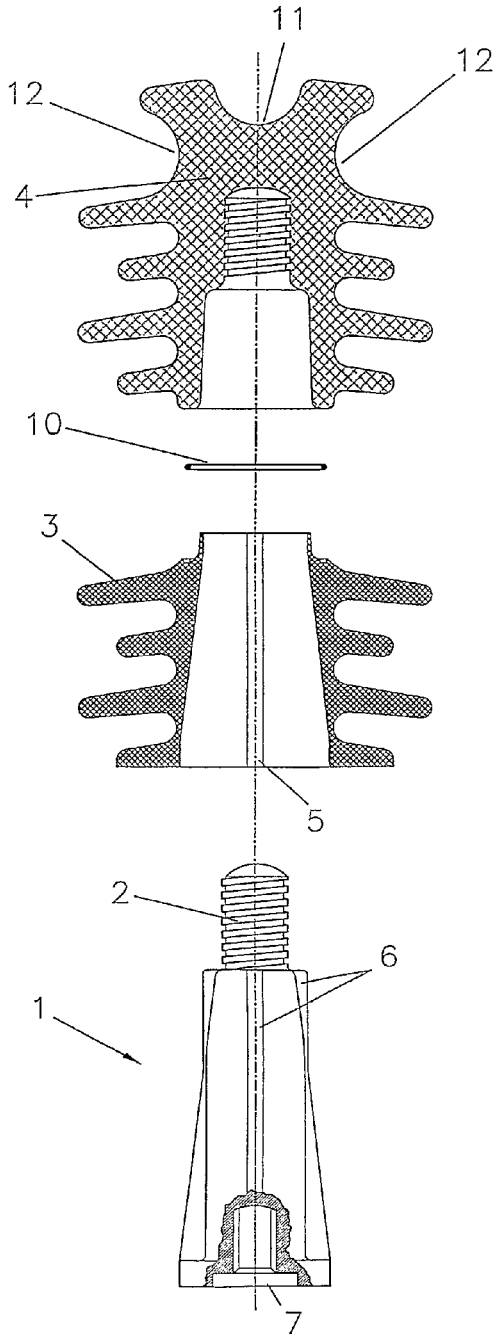
FIG. 3 is an exploded partially sectioned side view of the modular polymeric insulator of FIG. 2.

In details, as clearly shown in FIG. 3, the modular polymeric insulator 20 of the present invention comprises a first insulating module 3, and a second insulating module 4 which is superimposed to the first insulating module 3.

The insulating modules 3, 4 are provided with sheds which protrude from the outer surface of said modules. Said sheds improve the electrical performance of the insulator since they extend the rated voltage thereof.

The modular polymeric insulator 20 further comprises a non-metallic pin 1 which extends through the first insulating module 3 and the second insulating module 4.

The insulating modules 3, 4 of the modular polymeric insulator 20 are provided with a bore for receiving the non-metallic pin 1.

The pin 1 includes, at the upper part thereof, a threaded portion 2 which allows the fixing thereof to the second insulating module 4.

The bore of the modular polymeric insulator 20, as well as the body of the pin 1, is preferably provided with a conical shape. Said shape advantageously confers to the insulator 20 a high flexural resistance and allows to maintain a correct positioning of the insulating modules after assembling.

Preferably, the pin 1 is provided with side lugs 6 and the bore of the insulating modules 3, 4 is provided with corresponding grooves 5. The lugs 6 and the grooves 5 improve the mechanical resistance of the insulator 20 and facilitate the assembling thereof.

The pin 1 further includes, at the lower part thereof, a recess 7 for receiving a means for fastening the modular polymeric insulator 20 to a supporting element (not shown), e.g. a pole. Generally, the modular polymeric insulator 20 is fastened to the pole cross arms which are made of wood or other materials.

Preferably, the fastening means is a metallic pin. More preferably, the metallic pin has the same dimensions of the metallic pin which is generally used in the "Post type" insulators.

Extending from the bottom of the recess to a variable height of about 10 to 60 mm, the pin 1 is provided with a threaded portion which is suitable to engage and fasten thereto the fastening means.

Optionally, the recess 7 is provided with a metallic insert 9—which is fitted into the recess 7—that has a threaded portion for receiving and engaging the fastening means. Preferably, the metallic insert 9 is a tubular element the dimensions of which (height and internal diameter) are selected to ensure a good mechanical interference with the insulating module as well as a suitable flexural strength. Furthermore, the presence of this metallic insert provides an electrostatic shield for the metallic pin.

Alternatively, the fastening means is a metallic bolt.

Optionally, the modular polymeric insulator 20 comprises an o-ring 10 which is positioned between adjacent insulating modules. For instance, in FIG. 3 the o-ring 10 is positioned between the first insulating module 3 and the second insulating module 4.

Preferably, the insulating modules 3, 4 of the modular polymeric insulator 20 are produced by injection moulding. Preferably, the insulating modules 3, 4 are made of high density polyethylene of (HDPE).

Preferably, the non-metallic pin 1 is produced by injection moulding of a polymeric material. Preferably, the polymeric material is chosen from the group comprising: polyamide (PA), polypropylene (PP), polyphenylene oxide—styrene (modified PPO).

Typically, the upper portion of the insulator is provided with a groove 11 for supporting the overhead power line.

Generally, the upper portion of the insulator is also provided with side necks 12 for supporting the overhead power line along deflected lengths (curves) of the power distribution network.

Preferably, in correspondence of the threaded portion 2, a filling paste 21 is used to avoid the presence of air gaps.

The modular polymeric insulator of the present invention was subjected to mechanical and electrical tests. The following results were obtained:

a) a flexural strength greater than 210 daN (tested in accordance with standard NBR 8159).

b) tensile strength along the direction of the pin above 900 daN;

c) compression strength above 300 daN;

d) creep after 1000 hours lower than 5 mm;

e) electrical tracking class, using method 2, criterion A of standard NBR 10296, of at least 2.75 kV;

f) radio interference voltage below 10 μV;

g) perforation voltage under lightning impulse above 350 kV.

Furthermore, the modular polymeric insulator in accordance with the present invention (sample A) was subjected to some electrical tests and the results were compared with a "Pin type" insulator provided with a non-metallic pin and a covering in accordance with document PI 0103075-2 mentioned above (sample B).

The following results were obtained:

a) Withstand AC dry (according to IEC 60060 or NBR 6936): 101 kV for sample A and 92 kV for sample B;

b) Withstand AC under rain (according to IEC 60060 or NBR 6936): 62 kV for sample A and 64 kV for sample B;

c) Lightning impulse positive (according to IEC 60060 or NBR 6936): 197 kV for sample A and 160 kV for sample B;

d) Lightning impulse negative (according to IEC 60060 or NBR 6936): 214 kV for sample A and 202 kV for sample B.

The invention claimed is:

1. A modular polymeric insulator for overhead power distribution networks, comprising:

a first insulating module adjacent to a supporting element of said modular polymeric insulator;

at least one further insulating module superimposed to said first insulating module; and a non-metallic pin extending from the supporting element through said first insulating module and at least partially into said at least one further insulating module, wherein the non-metallic pin comprises:

a recess;

a metallic insert fitted within the recess of the non-metallic pin; and a metallic fastener configured to engage, within the recess, the metallic insert and to secure the modular polymeric insulator to the supporting element, and wherein the metallic insert provides an electrostatic shield for the metallic fastener.

2. The modular polymeric insulator according to claim 1, wherein the first and at least one further insulating modules comprise a bore for receiving said non-metallic pin.

3. The modular polymeric insulator according to claim 1, wherein the non-metallic pin comprises a threaded portion.

4. The modular polymeric insulator according to claim 2, wherein the bore and the non-metallic pin comprise a conical shape.

5. The modular polymeric insulator according to claim 1, wherein the non-metallic pin comprises longitudinal side lugs.

6. The modular polymeric insulator according to claim 5, wherein the first and at least one further insulating modules comprise grooves corresponding to said longitudinal side lugs.

7. The modular polymeric insulator according to claim 1, wherein said metallic fastener is a metallic pin.

8. The modular polymeric insulator according to claim 1, wherein said metallic insert is tubular.

9. The modular polymeric insulator according to claim 8, wherein said metallic insert comprises a threaded portion for receiving and engaging said metallic fastener.

10. The modular polymeric insulator according to claim 1, wherein said metallic fastener is a metallic bolt.

11. The modular polymeric insulator according to claim 1, further comprising at least one o-ring which is positioned between adjacent said first and at least one further insulating modules.

12. The modular polymeric insulator according to claim 1, wherein the non-metallic pin comprises a polymeric material.

13. The modular polymeric insulator according to claim 12, wherein said polymeric material is selected from the group of polyamide, polypropylene and polyphenylene oxide-styrene.

14. The modular polymeric insulator according to claim 1, wherein the non-metallic pin is produced by injection moulding.

15. The modular polymeric insulator according to claim 1, wherein the first and at least one further insulating modules comprise high density polyethylene.

16. The modular polymeric insulator according to claim 1, wherein the insulating modules are produced by injection moulding.

17. The modular polymeric insulator according to claim 1, wherein the first and at least one further insulating modules are provided with sheds.

18. A modular polymeric insulator for overhead power distribution networks, comprising:

a first insulating module adjacent to a supporting element of said modular polymeric insulator;

at least one further insulating module superimposed to said first insulating module;

a non-metallic pin extending from the supporting element through said first insulating module and at least partially into said at least one further insulating module; and a plurality of side lugs extending longitudinally on an outside surface of the non-metallic pin, the non-metallic pin and plurality of side lugs unitarily formed from a single material, wherein at least a portion of the length of said plurality of side lugs is disposed within said first insulating module.

19. The modular polymeric insulator according to claim 18, wherein the first insulating module comprises a plurality of groves extending longitudinally on an internal surface of the first insulating module and configured to engage the plurality of side lugs.

20. The modular polymeric insulator according to claim 18, wherein the plurality of side lugs are enclosed by a group of structures comprising the non-metallic pin, the first insulating module, and at least one further insulating module.

* * * * *